US006698141B2

(12) United States Patent
Silberman et al.

(10) Patent No.: US 6,698,141 B2
(45) Date of Patent: Mar. 2, 2004

(54) CONVERTIBLE STADIUM AND METHOD OF OPERATING

(75) Inventors: Cyril Silberman, Minnetonka, MN (US); David Sadinsky, Minneapolis, MN (US); Bart Riberich, Brooklyn Park, MN (US); Andrew Cheng, New Brighton, MN (US); Lennart Nielson, Edina, MN (US); Terry Thompson, Minneapolis, MN (US); Timothy J. Kline, Minnetonka, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 0 days.

(21) Appl. No.: 10/054,433

(22) Filed: Jan. 22, 2002

(65) Prior Publication Data

US 2002/0129561 A1 Sep. 19, 2002

Related U.S. Application Data

(60) Provisional application No. 60/263,645, filed on Jan. 23, 2001.

(51) Int. Cl.[7] ..... E04B 3/10

(52) U.S. Cl. ..... 52/6; 52/7; 52/64; 52/66; 52/126.1; 52/126.5; 52/741.1; 427/42; 427/85; 427/92; 427/94

(58) Field of Search ..... 52/6, 7, 64, 741.1, 52/66, 126.1, 126.5; 472/92, 85, 42, 94

(56) References Cited

U.S. PATENT DOCUMENTS

| | | | | |
|---|---|---|---|---|
| 2,052,217 A | | 8/1936 | Sibour et al. | |
| 2,603,171 A | | 7/1952 | Smith | |
| 2,642,162 A | | 6/1953 | Tobias | |
| 3,009,211 A | | 11/1961 | Hansen et al. | |
| 3,213,571 A | | 10/1965 | Olson | |
| 3,288,158 A | | 11/1966 | Gugliotta | |
| 3,534,511 A | | 10/1970 | Cappella | |
| 3,580,573 A | * | 5/1971 | Noonan et al. | 473/470 |
| 3,608,252 A | | 9/1971 | Bisson | |
| 3,766,691 A | | 10/1973 | Ray | |
| 3,801,421 A | * | 4/1974 | Allen et al. | 428/17 |
| 3,863,388 A | * | 2/1975 | Loads | 47/56 |

(List continued on next page.)

FOREIGN PATENT DOCUMENTS

| | | |
|---|---|---|
| JP | 2-217539 A | 8/1990 |
| JP | 2-269237 A | 11/1990 |
| JP | 3-87434 A | 4/1991 |
| JP | 3-115632 A | 5/1991 |
| JP | 4-323446 A | 11/1992 |
| NL | 8006712 | 7/1982 |

*Primary Examiner*—Carl D. Friedman
*Assistant Examiner*—Christy Green
(74) *Attorney, Agent, or Firm*—Knoble & Yoshida, LLC

(57) ABSTRACT

A convertible public exhibition facility includes a stadium having an exhibition area and a seating area that is situated about the exhibition area for permitting spectators to view activities taking place in the exhibition area. The exhibition facility further includes a movable natural grass activity platform that has a surface area of natural grass that is at least 10,000 square feet and that is constructed so as to have a characteristic frequency of at least 6 Hz. Situated within the natural grass activity platform is a transport mechanism that is constructed and arranged so as to be able to move the natural grass activity platform as a complete unit from a location that is outside of the stadium to a location that is within the exhibition area. Preferably, the location that is outside of the stadium is an outdoor location that provides optimal conditions for the growth of natural grass.

27 Claims, 6 Drawing Sheets

U.S. PATENT DOCUMENTS 4,023,506 A * 5/1977 Robey ..... 47/58.1 R
4,044,179 A * 8/1977 Haas, Jr. ..... 428/17
4,175,361 A 11/1979 Kumode
4,257,199 A 3/1981 Kuboyama
4,268,551 A * 5/1981 Moore, Jr. ..... 428/17
4,348,833 A 9/1982 Nagoya
4,462,184 A * 7/1984 Cunningham ..... 47/58.1 R
4,587,775 A 5/1986 Lewis et al.
4,616,451 A 10/1986 Glick
4,676,033 A 6/1987 Allen et al.
4,682,449 A 7/1987 Berger
4,688,357 A * 8/1987 Deaton ..... 52/9
4,706,419 A 11/1987 Adachi et al.
4,716,691 A 1/1988 Allen et al.
4,727,688 A 3/1988 Kida et al.
4,738,057 A 4/1988 Logan
4,751,800 A 6/1988 Kida et al.
4,802,314 A 2/1989 Schildge, Jr.
4,831,792 A 5/1989 Berger
4,833,837 A 5/1989 Bonneau
4,896,404 A * 1/1990 Garner ..... 24/415
4,907,793 A * 3/1990 Wund ..... 472/92
4,916,855 A * 4/1990 Halliday et al. ..... 47/1.01 F
4,920,707 A 5/1990 Moskaliuk et al.
4,926,586 A * 5/1990 Nagamatsu ..... 47/65.9
4,936,060 A 6/1990 Gelinas et al.
4,942,698 A 7/1990 Kumagai
4,995,203 A 2/1991 Brisbin et al.
5,007,214 A 4/1991 Itami et al.
5,010,695 A 4/1991 Schildge, Jr.
5,027,565 A 7/1991 Sugizaki
5,035,093 A 7/1991 Parazader et al.
5,058,332 A 10/1991 Masuyama et al.
5,062,243 A 11/1991 Kumagai
5,063,730 A 11/1991 Muramoto et al.
5,103,600 A 4/1992 Geiger et al.
5,117,594 A 6/1992 Muramoto et al.
5,167,097 A 12/1992 Robbie et al.
5,187,894 A 2/1993 Ripley, Sr. et al.
5,203,125 A 4/1993 Sugizaki
5,257,481 A 11/1993 Reppas et al.
5,257,485 A 11/1993 Kawaguchi et al.
5,309,846 A * 5/1994 Peterson ..... 108/53.3
5,365,704 A * 11/1994 Ray ..... 52/64
5,371,983 A 12/1994 Kawaguchi et al.
5,394,660 A 3/1995 Haris
5,489,317 A * 2/1996 Bergevin ..... 47/1.01 R
5,595,021 A * 1/1997 Ripley et al. ..... 47/66.5
5,617,671 A * 4/1997 Rogers et al. ..... 47/1.01 F
5,653,066 A 8/1997 Schildge, Jr.
5,682,711 A 11/1997 Warczak
5,746,028 A 5/1998 DiBenedetto
5,778,603 A 7/1998 Reppas
5,896,708 A 4/1999 Doi et al.
5,921,032 A * 7/1999 Labinski ..... 52/9
5,927,022 A 7/1999 Hirakawa et al.
6,029,397 A * 2/2000 Motz et al. ..... 47/58.1 R
6,168,532 B1 * 1/2001 McCaffrey ..... 472/92
6,227,989 B1 * 5/2001 Reid ..... 473/490
6,263,616 B1 * 7/2001 Hummer ..... 47/65.9
6,286,264 B1 * 9/2001 Peuler ..... 52/6
6,295,756 B1 * 10/2001 Bergevin ..... 47/1.01 R
6,385,912 B1 * 5/2002 Wessel et al. ..... 52/6
6,398,455 B1 * 6/2002 V.o slashed.lstad ..... 405/43
6,474,023 B1 * 11/2002 Takeuchi ..... 52/8
6,503,159 B2 * 1/2003 Pehr ..... 473/477

* cited by examiner

SCHEMATIC LAYOUT OF MOTOR CONTROL ENCLOSURE

CONVERTIBLE STADIUM AND METHOD OF OPERATING

This application claims priority under 35 USC §119(e) based on U.S. Provisional Application Ser. No. 60/263,645, filed Jan. 23, 2001, the entire disclosure of which is hereby incorporated by reference as if set forth fully herein.

BACKGROUND OF THE INVENTION

1. Field of the Invention

This invention relates generally to the field of large stadiums, such as athletic stadiums, and in particular to stadiums in which is desired to have a natural grass activity area, such as athletic playing field.

2. Description of the Related Technology

Historically, when most professional sports stadiums were of the fully outdoor, open bowl design, growing and maintaining a natural grass playing field was not considered difficult, and was in fact the norm. This changed, however, with the advent of the large, indoor domed professional sports stadiums in the 1970s. It being impractical to grow natural grass in a domed stadium because of the lack of sunlight and natural precipitation, all of the large, domed athletic stadiums utilize artificial turf when hosting athletic events, such as baseball or football, that require a grass-like playing surface.

In recent years, however, professional athletes, their unions, and the teams and leagues themselves have begun to express a clear preference for natural grass playing fields. This is particularly true for baseball and football players in the United States. Natural grass is felt by many players to be safer, more pleasant, and less physically taxing to play on than artificial turf.

In the last few years, retractable roof stadiums have come into play with the intention of providing sufficient sunlight to the field to grow natural turf. While this has worked reasonably well in most cases, it has been difficult to aggressively grow grass. Even though the stadium roof will open, it generally does not adequately provide the two most important elements to grow grass, which are direct sunlight for a maximum period of time each day and a warm, moist environment at field level to promote growth. It is problematic that most stadiums only allow a shaft of light onto the field because the stadium support walls and other devices block the sun early in the morning and late in the afternoon. Secondly, most stadiums are air-conditioned, and since most stadiums are built in a depressed cavity below ground level, the cold air-conditioned air, even when the roof is opened, tends to linger at field level. This cool, dry air tends to inhibit the growth of grass and has caused problems in the industry.

Another factor that has been an impediment to be widespread deployment of natural grass to playing surfaces in retractable roof type stadiums is the relative difficulty in reconfiguring the exhibition area in a stadium that utilizes natural grass to an alternative purpose, such as for basketball, rodeo exhibitions, circuses and the like. Unlike artificial turf, natural grass cannot be covered for an indefinite period of time, it is difficult to temporarily move and further can cause problems of condensation in the event that a temporary surface is erected above it.

Attempts have been made to design a movable game field that can be moved from one location to another. U.S. Pat. No. 5,746,028 to DiBenedetto discloses a movable grass field that is mounted on a superstructure base that is secured to and spans a system of wheels for movement in and out of a sports stadium. To the best of the knowledge of the present inventors, such a system has never been successfully deployed in a large sports stadium. As the inventors are aware based on their widespread experience in the design and construction of very large structures, a number of practical problems are presented that have deterred the practical implementation of large mobile platforms bearing natural turf. One practical problem is that existing stadiums are designed so as to have exhibition levels that are at a predetermined elevation with respect to the surrounding seating area. It has long been felt that a movable turf platform would necessarily because of the tremendous weight of the turf and underlying soil itself need to be made so as to be prohibitively thick and bulky. In addition, vibrational characteristics are a major concern. In sports such as professional American football, for example, twenty-two large men will periodically be simultaneously exerting themselves on the field. In order for game play to be acceptable to the athletes, the field must have a solid feel to it, as if no independent platform existed. This is problematic and is also antagonistic to the requirement that the platform be as compact and unobtrusive as possible.

A need exists in the industry for an improved stadium design and method that will permit more effective growth of natural grass for a stadium, provide an acceptable surface for athletic play and that will further permit efficient reconfiguration of the stadium in the event that an alternative event not requiring natural grass is to be hosted.

SUMMARY OF THE INVENTION

Accordingly, it is an object of the invention to provide an improved stadium design and method that will permit more effective growth of natural grass for a stadium, provide an acceptable surface for athletic play and that will further permit efficient reconfiguration of the stadium in the event that an alternative event not requiring natural grass is to be hosted.

In order to achieve the above and other objects of the invention, a method of operating a stadium according to a first aspect of the invention includes steps of positioning a natural grass activity platform in a first location that is outside of the stadium, the natural grass activity platform having a surface area of natural grass that is at least 10,000 square feet and being constructed and arranged to have a characteristic frequency that is at least 6 Hz; and moving the natural grass activity platform as a complete unit to a second location that is within the stadium, the step of moving the natural grass activity platform being performed without disassembly and reassembly of the natural grass activity platform.

According to a second aspect of the invention, the convertible public exhibition facility may include a stadium having an exhibition area and a seating area that is situated about the exhibition area for permitting spectators to view activities taking place in the exhibition area; a movable natural grass activity platform that has a surface area of natural grass that is at least 10,000 square feet and is constructed and arranged to have a characteristic frequency of at least about 6 Hz; and a transport mechanism that is constructed and arranged so as to be able to move the natural grass activity platform as a complete unit from a first location outside of the stadium to a second location that is within the exhibition area.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
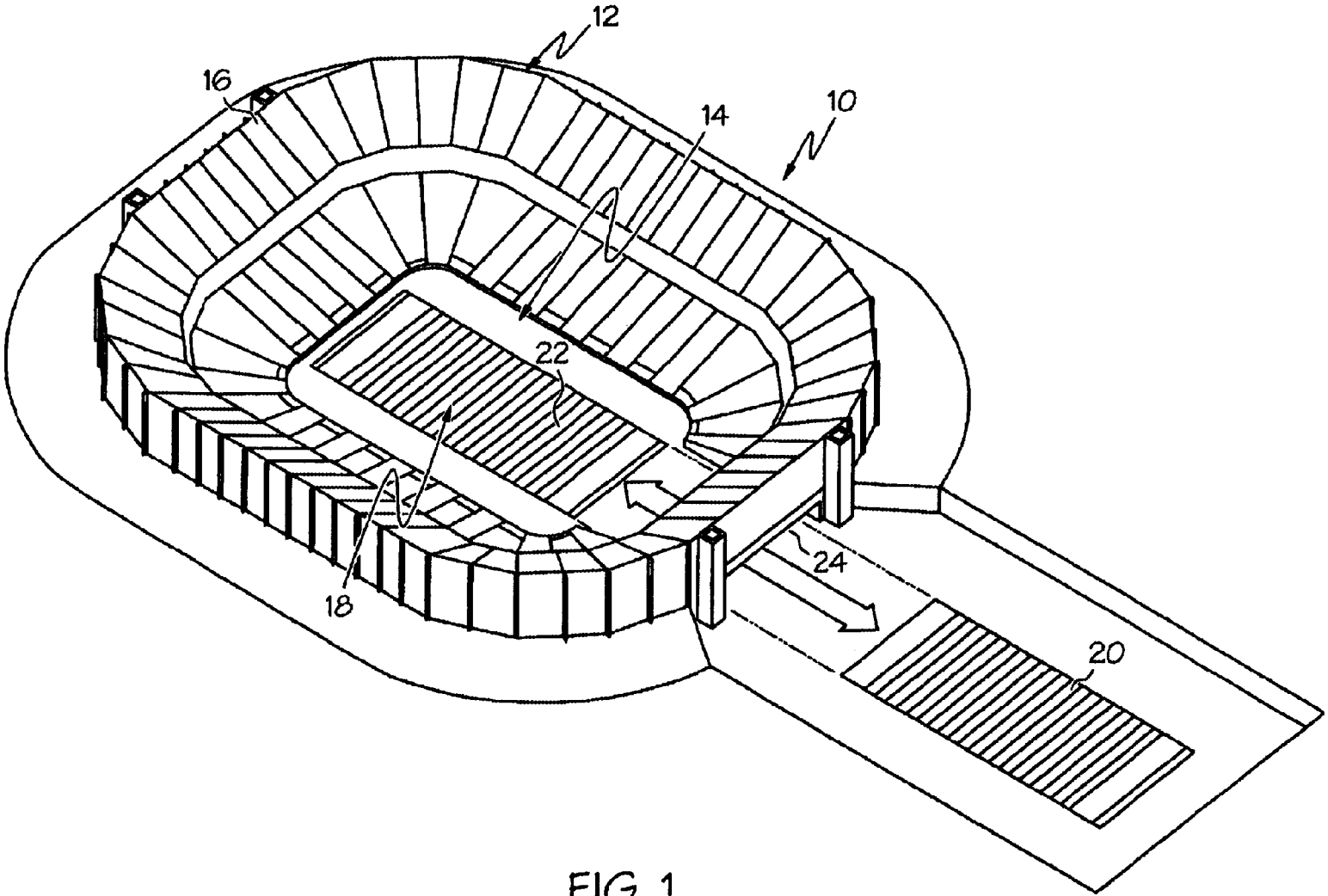
FIG. 1 is a perspective view of a convertible public exhibition facility that is constructed according to a preferred embodiment of the invention.

Referring now to the drawings, wherein like reference numerals designate corresponding structure throughout the views, and referring in particular to FIG. 1, a convertible public exhibition facility 10 that is constructed according to a preferred embodiment of the invention includes a stadium 12 having an exhibition area 14 and a seating area 16 that is situated about the exhibition area 14 for permitting spectators to view activities taking place in the exhibition area 14. Public exhibition facility 10 further includes a movable natural grass activity platform 18 that has a surface area of natural grass that is at least 10,000 square feet in area. More preferably, the surface area of natural grass is at least 40,000 square feet in area and even more preferably at least 80,000 square feet. It is anticipated that the surface area of natural grass will be large enough to fit an entire playing field that is desired for a particular stadium 12, so that there will be no need to piece together the playing field or other exhibition area using more than one activity platform 18, although this could be done within the scope of the invention if so desired. For example, in a stadium design that has been completed to be used by a professional American football team, the dimensions of the surface area of natural grass are about 400 feet in length and about 240 feet in width, making a surface area of about 96,000 square feet. It is anticipated that this will be typical of the dimensional requirements of professional and major collegiate sports stadiums constructed according to the invention in the future.

Figure 2:
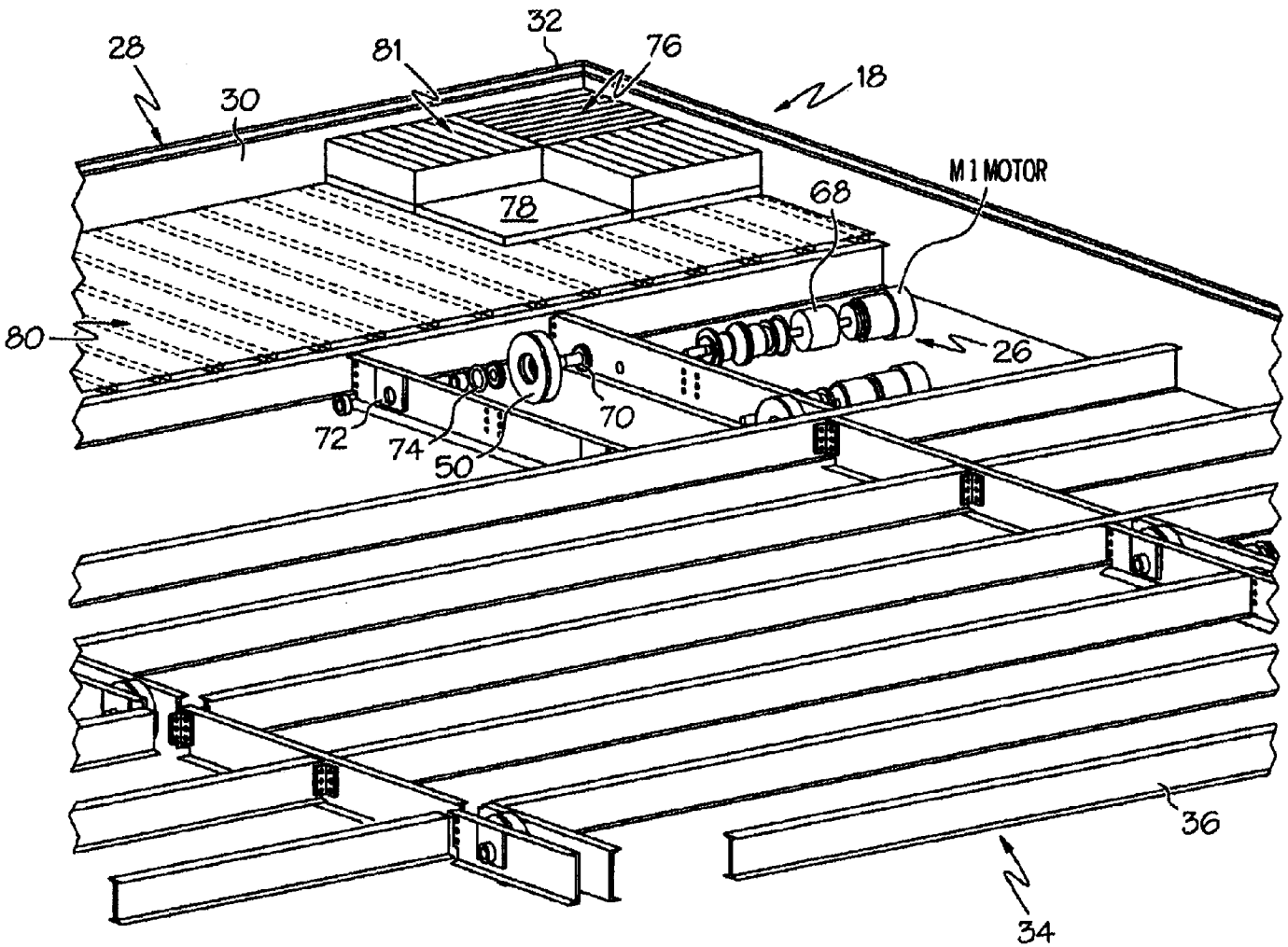
FIG. 2 is a fragmentary partially exploded isometric view depicting a portion of the facility that is shown in FIG. 1.
Figure 4:
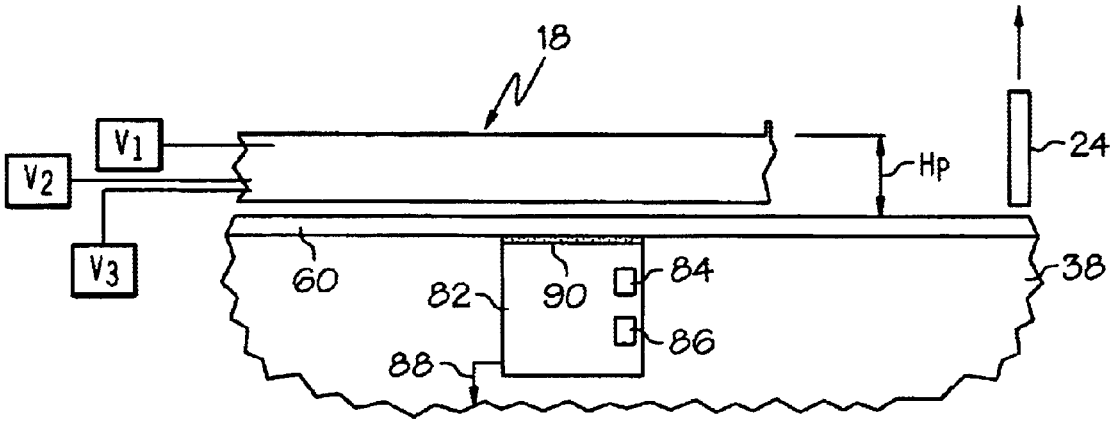
FIG. 4 is a second diagrammatical depiction showing another portion of the facility.

As may be seen in FIG. 1, the movable natural grass activity platform 18 is constructed and arranged so as to be movable by a transport mechanism 26, visible in FIG. 2, as a complete unit from a first location 20 that is located outside of the stadium 12 to a second location that is within the exhibition area 14 of the stadium 12. Preferably, the first location 20 is located in an area that will enjoy growing conditions that are superior to growing conditions within the stadium 12. When the activity platform 18 is positioned in the first location, the exhibition area 14 may be configured as an alternative activity area for a public event that does not require the natural grass activity platform 18. For example, exhibition area 14 may be fitted with a hardwood floor for a basketball, or for other convention activities such as auto shows, boat shows, tractor pulls, etc. To achieve the ability to move the natural grass activity platform 18 between the first and second positions 20, 22, on one edge of the stadium 12 a structural spanning truss system must be developed so there is a raceway, or channel for the platform 18 to exit the stadium 12. Secondly, as will be discussed in greater detail below, a plurality of rails or guides must be embedded in the base concrete slab for the stadium 12 to give adequate structural support for the immense weight of the platform 18 as it travels between the two positions. The activity platform 18 is then constructed to ride upon the embedded rails. Additionally, a door 24 is preferably provided at the location where the raceway or channel exits the stadium 12, as is shown in FIGS. 1 and 4. Door 24 must be constructed to be wide enough to allow the retractable activity platform 18 to exit the stadium 12 and then be closed up so that air-conditioning can continue without the exchange of air. The door 24 must have the ability to open completely out of the way to clear the field and then close up tight and encompass a locking system, which will resist wind loads and suction loads from internal and external forces. Thus, a system of wind locks must be incorporated into the retractable field door 24. The retractable field door 24 is preferably interlocked with the retractable field to prevent accidents.

According to one important aspect of the invention, the platform 18 is constructed so as to have a characteristic frequency that is at least about 6 Hz and more preferably about 7 Hz or greater. The specific techniques that are used to ensure the platform 18 enjoys a characteristic frequency within the preferred range are discussed in greater detail below.

According to another important aspect of the invention, the platform 18 is constructed so as to have a height $H_P$, calculated as being the vertical distance from the plane of the playing field to the portion of the wheel that context the underlying rail, as shown in FIG. 4, that is no more than about 60 inches, and is more preferably no more than about 45 inches. Most preferably, the vertical distance $H_P$ is no greater than about 36 inches. The goals of minimizing the vertical distance $H_P$ and maximizing the characteristic frequency of the platform 18 tend to be mutually antagonistic, so it should be understood that the ability of the platform 18 to achieve both of these goals is quite advantageous.

Figure 3:
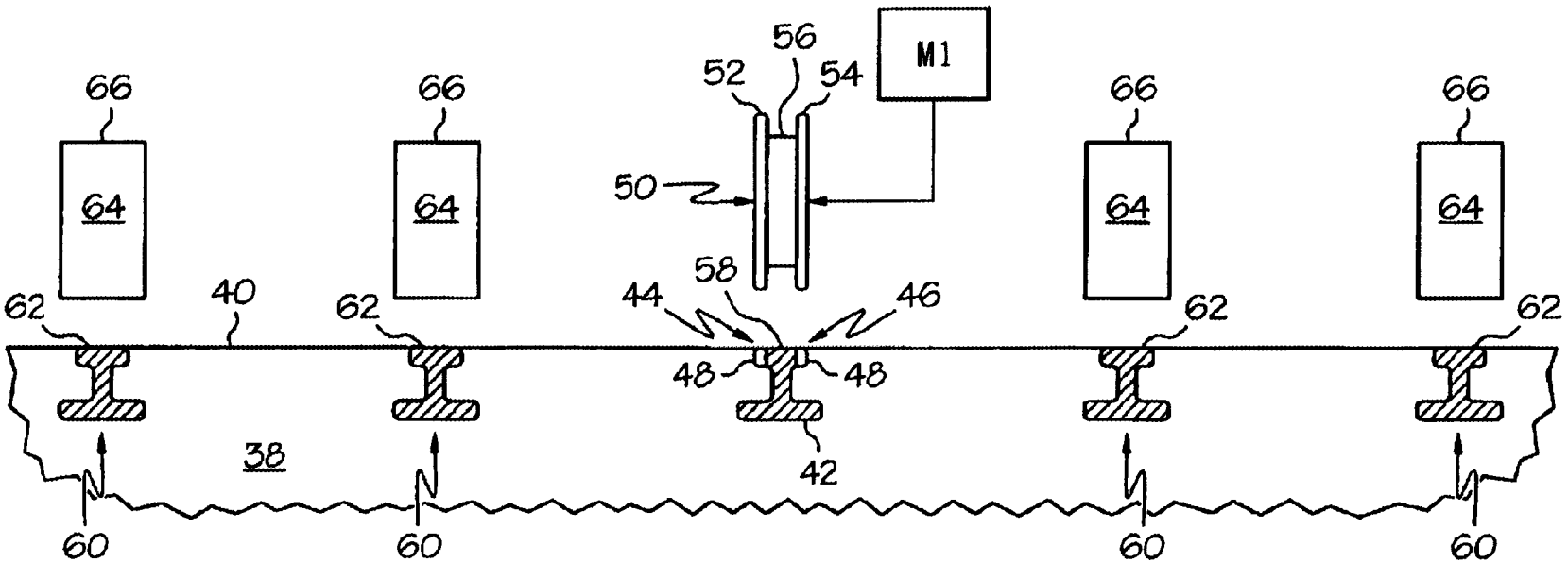
FIG. 3 is a diagrammatical depiction of a portion of the facility.

Looking now to FIG. 2, it will be seen that the movable natural grass activity platform 18 includes a containment pan 28 having a peripheral lip portion 30 upon which cushioning material 32 such as a foam rubber material is provided for protecting athletes and other bystanders against injury that might otherwise occur as a result of contact with the containment lip 30. Containment pan 28 is secured to and supported by a structural framework 34 that in the preferred embodiment includes a plurality of I-beams 36 that are interconnected as shown in FIG. 2 to form a grid. As shown in FIG. 3, the facility 10 preferably includes a concrete floor 38 having an upper surface 40 that is generally flat, although it should be understood that is typical for a slight grade to be incorporated for purposes of drainage. According to another important aspect of the invention, a plurality of substantially parallel rails are secured to the floor 38 and extend substantially between the first and second locations 20, 22. The substantially parallel rails, which are shown in cross-section in FIG. 3, preferably include at least one lateral stability control rail 42 that is embedded within the concrete floor 38 so that its upper surface 58 is substantially flush with the upper surface 40 of the floor 38. Recesses 44, 46 are defined in the concrete floor 38 on each side of the top surface 58 of the lateral stability control rail 42. As is further shown in FIG. 3, the transport mechanism 26 includes a plurality of lateral stability control wheels 50, each of which has a first flange 52, a second flange 54 and a surface 56 that is sized and shaped to be supported by the upper surface 58 of the lateral stability control rail 42. In operation, the first flange 52 of the wheels 50 is received within the first recess 44 on one side of the rail 42, while the second flange 54 is received in the second recess 46. The presence of the first flange 52 prevents lateral displacement of the wheels 50 and thus the platform 18 in a direction that would be to the right as shown in FIG. 3. Similarly, the presence of the second flange 54 prevents lateral displacement of the wheel 50 and thus the platform 18 in a leftward direction as it would be viewed in FIG. 3. As may further be seen in FIG. 3, elastomeric material 48 is provided within each of the recesses 44, 46. The purpose of the elastomeric material 48 is to maintain a flat surface throughout the facility that is flush with the upper surface 40 of the fourth 38, so as to minimize inconvenience or potential safety risks to machines and pedestrians within the facility.

As may be seen in FIGS. 2 and 3, electric motor M1 is provided to drive the lateral stability control wheel 50, as will be discussed in greater detail below. Also embedded in the concrete floor 38 are a plurality of additional rails 60 that are spaced so as to be substantially parallel to the lateral stability control rail 42. Each of the rails 60 has an upper surface 62 that is preferably positioned so as to be flush with the upper surface 40 of the concrete floor 38. The transport mechanism 26 further includes a plurality of wheels 64 each having a peripheral engagement surface 66 that is shaped to traverse the upper surface 62 of the respective guide rail 60, as may be seen in FIG. 3. In addition, as may also be seen in FIG. 3, the peripheral engagement surface 66 is preferably constructed so as to be substantially wider than the upper surface 62 of the respective guide rail 60, so as to ensure that the respective surfaces remain in contact even in the event of significant thermal expansion or contraction. The wheels 50, 64 are preferably laterally spaced with respect to reach other so as to ensure the best possible alignment with the corresponding rails 42, 60. In practice, however, dimensional variations resulting from thermal expansion and contraction as well as other factors including the tendency of all large structures to experience some settling over time will tend to change the lateral distance between the rails 42, 60. One significant advantage of this aspect of the invention is that because the lateral stability is governed exclusively at one rail 42 and with one corresponding wheel 50, dimensional variations that change the distance between the lateral stability control rail 42 and the other rails 60 or dimensional variations that occur between the wheel 50 and the other wheels 64 will be tolerated to some extent and simply resulting in minor shifting of the position of one or more of the wheels 64 upon the respective rail bearing surface 62.

Referring now to FIG. 2, it will be seen that the transport mechanism 26 includes a plurality of electric motors M1, M2, . . . $M_n$, each of which is coupled to the corresponding lateral control stability wheel 50 by an appropriate transmission assembly including a reduction gear 68. Each of the wheels 50 are supported for rotation with respect to one of the longitudinally extending I-beams 36 by means of a first bearing 70 and with respect to a similar longitudinally extending sister I-beam 72 by a second bearing 74. The longitudinally extending sister I-beam 72 is mounted so as to be parallel to and spaced from the first longitudinally extending I-beam 36 by a distance that is just sufficient to permit placement of the wheel 50. As may further be seen in FIG. 2, cellular decking 80 is applied to the top of the framework 34. The cellular decking 80 is constructed as a number of steel channel elements that have concrete hardened within the recesses and channels thereof so as to create a composite concrete/steel construction, the benefits of which are described below.

Several aspects of the invention are together responsible for maximizing the characteristic frequency of the platform 18 while minimizing its bulk. First, the structural steel system is composite to the concrete deck above, better described as a monolithic assemblage of structural steel elements, anchor collars and poured reinforced concrete, all acting together and referred to as composite concrete deck. This feature tends to achieve a more rigid structural assembly producing a higher frequency.

Secondly, the structural steel beams are designed and implemented as multi-span structural members rather than simple span. Embodying this feature produces a more desirable structural system with less steel and more rigidity, producing a higher frequency when it is excited by players on the top of the field.

Third, the span between rails is minimized, which reduces the amount of steel required and increases the rigidity of the field in general, producing a higher frequency of resonation. In situating the rails closer together, on the surface we have cluttered up the secondary playing field beneath the main playing field. However, by implementing an embedded track flush with the concrete surface above we have saved the floor and made it even more serviceable for various events than any other patent holder, thereby achieving the best of both worlds.

A thin layer 78 of waterproof concrete is provided on top of the cellular decking 80, and a stratified biolayer 81 is positioned on top of the layer 78 of waterproof concrete. In the preferred embodiment, the stratified biolayer 81 includes a first layer of coarse sand or crushed rock that is approximately two inches in depth, and then a layer of permeable Geo fabric for entering purposes. Approximately eight inches of grated soil is positioned on top of the Geo fabric, with a layer of sod that is about two inches in thickness being applied to the top of the grated soil. It should be understood that the biolayer could alternatively be constructed in an almost infinite number of different methods of placement and construction, which would all be within the scope of the invention.

Referring now to FIG. 4, it will be seen that another advantageous feature of the invention is the provisions of a pit 82 that is defined as a recess within the concrete floor 38 of the facility 10. Pit 82 is preferably large enough for maintenance personnel and their equipment, and is preferably provided with a supply 84 of electricity and a supply 86 of hydraulic or pneumatic pressure. In addition, pit 82 is provided with a drain 88 for draining any water or other fluids that may end up in the pit 82. A grate 90 is preferably positioned over the pit 82 so as to have a top surface that is flush with the surface 40 of the floor 38.

As is further shown in FIG. 4, platform 18 is further preferably provided with an internal irrigation system that is connected to a source of water via a plurality of pipes and valves V1, V2, . . . Vn that are interposed within the pipes. In addition, a drainage system is provided in the platform 18 that is also controlled at least one valve V3. The valves are preferably solenoid operated and are controlled automatically by a controller 92 that is schematically depicted in FIG.

Figure 5:
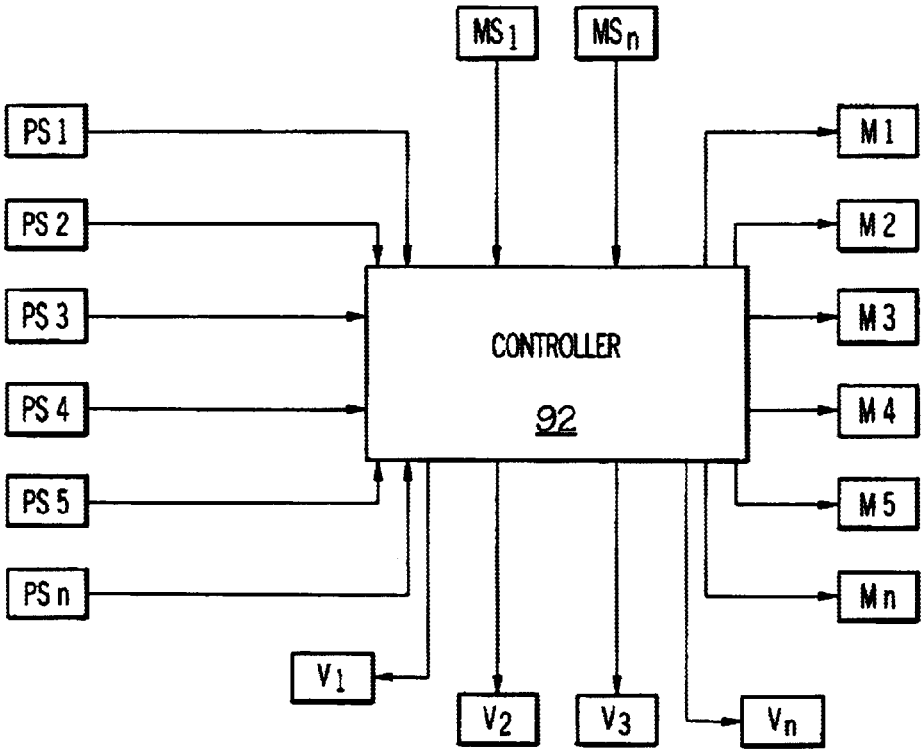
FIG. 5 is a schematic diagram depicting a control system that is preferably employed in the facility that is shown in FIGS. 1–4.

5. As FIG. 5 shows, a plurality of position sensors PS1, PS2, . . . PS$^n$ are provided to sense the longitudinal position of one specific portion of the platform 18 with respect to the it underlying facility. Controller 92, based upon input received from the different position sensors will control of the plurality of different motors M1, M2, M3, . . . $M_n$ so as to ensure that the platform 18 and its different sides remain in alignment as it may travel between the first and second locations 20, 22. For example, if the position sensors indicate that one side of the platform 18 is longitudinally trailing the other side by even a small amount during movement, power may be reduced to motors that are located near the leading side for power may be increased to motors that are located near the trailing side in order to correct alignment. A plurality of moisture sensors MS1, . . . $MS_n$, may further be provided within the biolayer 81 of the platform 18, and the sensors will provide input to the controller 92. In response to this input, controller 92 may selectively actuate one or more valves V1, V2 in order to raise the moisture level in a particular zone or location of the biolayer 81. Similarly, controller 92 may actuate one or more of the drainage valves in order to cause excess moisture to drain from the platform 18 in an area that has received excess precipitation.

The acceleration and deceleration of the electric motors is an important aspect of the invention. The conventional method of operating equipment is referred to as "across the line starting", whereby a magnetic contactor energizes the electric motors and the motors begin outputting fall torque within 1 or 2 seconds. Traditionally, when the mechanism begins to move a conventional 3-phase motor will output 3 times its nameplate horsepower and torque. On startup, when natural initial forces resist the acceleration of the mechanism, the traction wheel assembly will frequently slip slightly on the track as it tries to accelerate the mechanism. This slipping action will cause excessive wear, significant building vibration and general abuse of the collateral machinery. The same is true on a conventional mechanism when stopping. When the power is removed a fail-safe spring set brake is normally energized, which brings the mechanism to a rapid stop causing the traction wheel to slip and significant vibrations, wear & tear, and other objectionable phenomena to occur.

Figure 7:
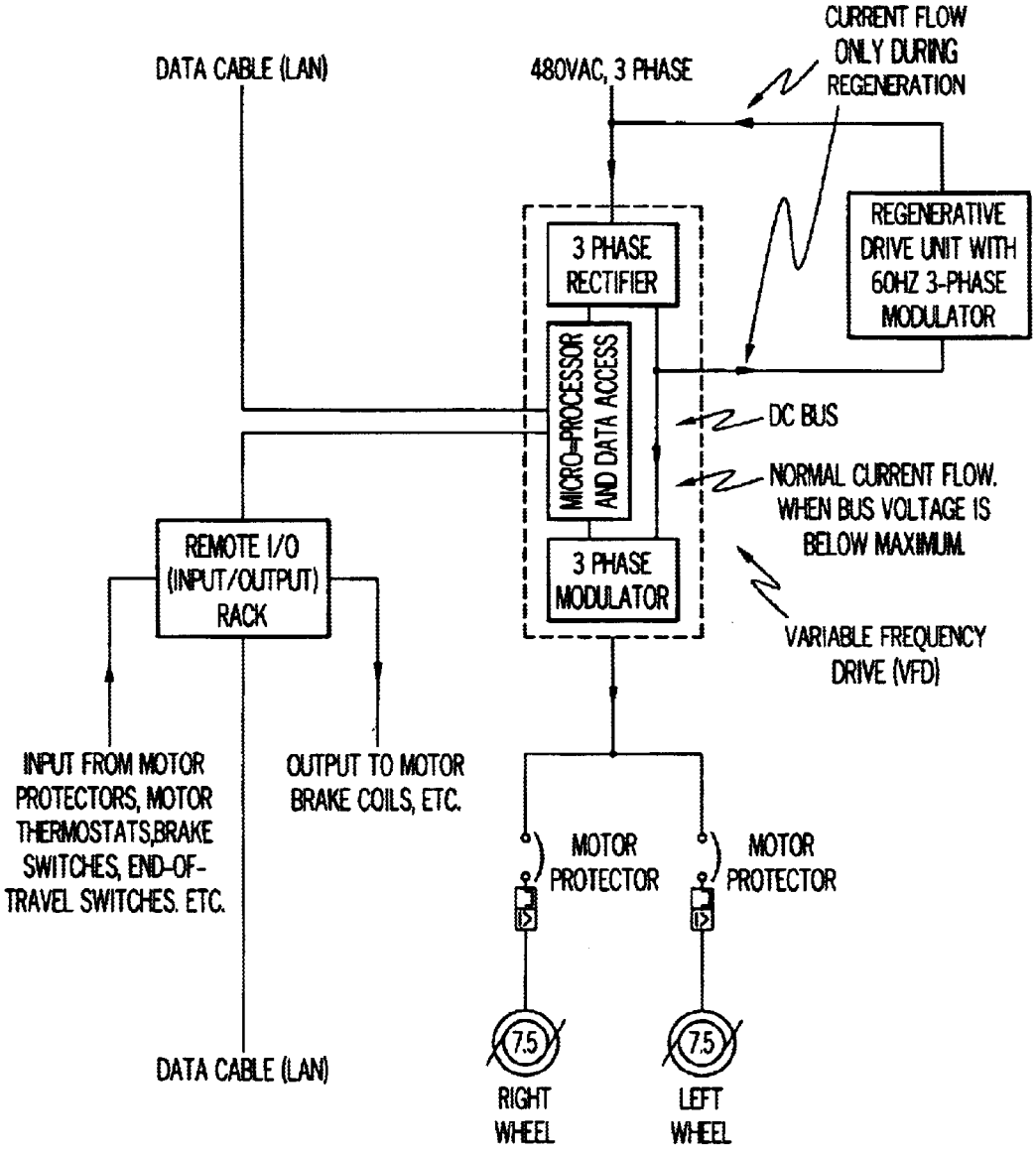
FIG. 7 is a schematic diagram of a motor control enclosure according to the preferred embodiment of the invention.

As shown in FIG. 7, the preferred embodiment of the invention utilizes a Variable Frequency Drive (VFD), which captures conventional AC current and converts it to DC current, then reconstructs the sine wave of the current back to a regulated AC sign form. This feature is very useful in the acceleration/deceleration phase. For example, on start-up the VFD will output current at approximately 5 to 10 Hertz rather than the conventional line current of 60 Hertz. Most all 3-phase AC motors are 4-pole motors. Preferably, conventional 3-phase 4-poles motors are used because they are extremely economical to purchase. A conventional 4-pole motor when powered with 60 Hertz current always turns at exactly 1750 RPM. The relationship of the 4-poles and the alternating current at 60 Hertz is fundamental, and the machine will always seek to run at 1750 RPM. With the application of the VFD the frequency can be reduced to as low as 5 Hertz, causing the motor to start at "creep" speed outputting a constant torque. At these low speeds it is required to inject a higher voltage to prevent rapid heat build-up, which is also a function of the micro-processor within the VFD. This micro-processor can be adjusted to output frequency on a sliding scale. Example: Over a period of 20 seconds the frequency will increase by 10 Hertz every 2 seconds. Thus, if the frequency begins at 10 Hertz, at the end of 10 seconds it will be at 100 Hertz causing the motor to run slightly faster than its normal RPM of 1750. This gives a gradual start, a gradual application of torque protecting the machinery, the building and all other mechanical equipment. The micro-processor is programmed based on a predetermined calculation regarding the maximum torque and inertia that collateral equipment can withstand. It is a function of the stiffness of the building structure, the weight of the retractable roof, and the stiffness of the collateral machinery. One important point is that the VFD is adjustable, and that by calculation is possible to arrive at the most favorable acceleration and/or deceleration curve.

The application of VFD's allows the equipment to be started at a very slow speed, and, in addition, to accelerate the equipment up to twice the normal speed of a standard 3-phase motor, thereby completing the cycle time at a much faster speed than a conventional arrangement. The VFD with the application of the Programmable Logic Controller (PLC) can also monitor the wind in and around the stadium. If it is found that the wind is of an excessive speed we can prevent the VFD from accelerating past a slower speed, thus protecting all of the machinery. This application of both the VFD and the PLC allows our mechanism to complete the opening cycle most of the time in half the speed of a conventional machine, while still maintaining the capability to slow down to ¼ the speed during high wind conditions to maintain safety. This arrangement is a significant improvement over conventional drives.

Another feature provided by the PLC, coupled to the VFD, is the ability for the operator to continuously monitor the motor voltage, the motor frequency, and the motor output torque. These figures are displayed on the operator's information screen and recorded continuously for historic reference and troubleshooting. These diagnostic features allow the operator confidence that the mechanism is functioning as intended and offer an early warning as soon as an inconsistency develops in the mechanism long before a serious failure would occur. The historical data logging is programmed to download through the internet on a high-speed communications link to a remote facility, thus enabling engineers to monitor all systems in the field to be sure they are working properly. This offers a much higher level of safety than was achievable in the past. The combination of these devices allows an unsophisticated owner with no engineering staff to operate highly technical equipment that heretofore could not be operated without a staff of engineers on-site, thereby significantly reducing the cost of ownership.

Figure 6:
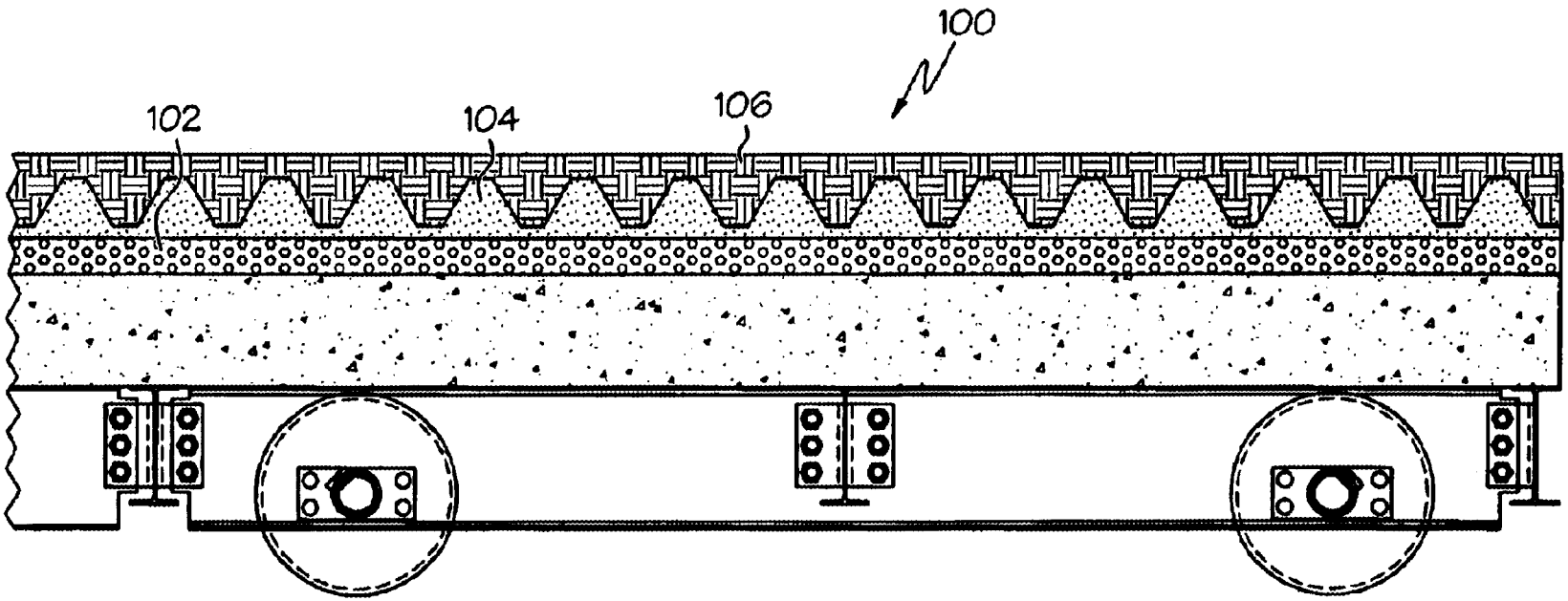
FIG. 6 is a diagrammatical view depicting another aspect of the invention.

Referring now to FIG. 6, an alternative method of constructing a biolayer 100 and support therefore would be to embody the same concrete deck with a layer 102 of course gravel, after which the application of a geo-technic technical membrane would be applied. Then, a system of course sand 104 would be installed above the membrane. The course sand would be installed in a wave pattern perpendicular to the long dimension of the field. The wave pattern more aptly described would be a series of peaks and valleys raked into the course sand whereby at its highest point the sand would be just 2" below the turf 106, and at its lowest point the course sand would be 8" below the turf field. The frequency or distance between the peaks would be approximately 3'–6' depending on the climatic conditions. The valleys between the peaks would then be filled with soil rich in nutrients and suitable to grow turf.

The advantage of this scheme would be evident in climates where torrential rains may occur from time to time. A torrential rain on the field may cause flooding sufficient to damage the turf 106 because the water could not drain through the subsoil fast enough. Thus, by having course sand very close to the surface we can prevent the accumulation of water puddles and degradation of the sod that would result. A field construction as described above would be useable, or playable, in a very short time after a torrential rainfall because it would improve its ability to quickly drain.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of operating a stadium, comprising steps of:

(a) positioning a natural grass activity platform in a first location that is outside of the stadium, said natural grass activity platform having a surface area of natural grass that is at least 10,000 square feet and being constructed and arranged to have a characteristic frequency that is at least 6 Hz; and (b) moving the natural grass activity platform as a complete unit to a second location that is within the stadium, said step of moving the natural grass activity platform being performed without disassembly and reassembly of the natural grass activity platform.

2. A method of operating a stadium according to claim 1, wherein step (a) is performed so that said first location is a location where the natural grass activity platform will enjoy growing conditions that are superior to growing conditions within the stadium.

3. A method of operating a stadium according to claim 1, further comprising a step of using the stadium for a public event while the natural grass activity platform is in the second location.

4. A method of operating a stadium according to claim 3, further comprising a step of:

(c) moving the natural grass activity platform as a complete unit from the second location and returning it to the first location that is outside of the stadium.

5. A method of operating a stadium according to claim 4, further comprising a step of deploying an alternative activity area within the stadium subsequent to step (c), and using the stadium with the alternative activity area for a public event that does not require the natural grass activity platform.

6. A method of operating a stadium according to claim 1, wherein step (a) is performed with a natural grass activity platform that has a surface area of natural grass that is at least 40,000 square feet.

7. A method of operating a stadium according to claim 6, wherein step (a) is performed with a natural grass activity platform that has a surface area of natural grass that is at least 80,000 square feet.

8. A method of operating a stadium according to claim 7, wherein step (a) is performed with a natural grass activity platform that has a characteristic frequency that is at least 7 Hz.

9. A method of operating a stadium according to claim 1, wherein said method is performed with a natural grass activity platform that includes a plurality of wheels that are positioned to traverse an underlying surface that is built into the stadium, and wherein the natural grass activity platform has a total height measured from a bottom of said wheels to a top of the surface area of natural grass that is no greater than about sixty inches.

10. A method of operating a stadium according to claim 9, wherein the method is performed with a natural grass activity platform having a total height that is no greater than about 45 inches.

11. A method of operating a stadium according to claim 10, wherein the method is performed with a natural grass activity platform having a total height that is no greater than about 36 inches.

12. A convertible public exhibition facility, comprising:

a stadium having an exhibition area and a seating area that is situated about the exhibition area for permitting spectators to view activities taking place in the exhibition area;

a movable natural grass activity platform, said platform having a surface area of natural grass that is at least 10,000 square feet and is constructed and arranged to have a characteristic frequency of at least about 6 Hz; and a transport mechanism that is constructed and arranged so as to be able to move said natural grass activity platform as a complete unit from a first location outside of the stadium to a second location that is within the exhibition area.

13. A convertible public exhibition facility according to claim 12, wherein said first location is a location where the natural grass activity platform will enjoy growing conditions that are superior to growing conditions within the stadium.

14. A convertible public exhibition facility according to claim 12, wherein said natural grass activity platform has a surface area of natural grass that is at least 40,000 square feet.

15. A convertible public exhibition facility according to claim 14, wherein said natural grass activity platform has a surface area of natural grass that is at least 80,000 square feet.

16. A convertible public exhibition facility according to claim 12, wherein said movable natural grass activity platform is constructed and arranged to have a characteristic frequency of at least about 7 Hz.

17. A convertible public exhibition facility according to claim 12, wherein said activity platform comprises at least one support wheel having a flange and wherein said facility further comprises at least one support rail that is securely mounted to a floor of said exhibition area, said support rail being positioned so that a top surface thereof is substantially flush with a surface of said floor, and wherein a recess is defined in said floor immediately adjacent to said support rail for receiving said flange during movement of said activity platform, and wherein a compressible material is positioned within said recess, whereby the floor of the exhibition area will be substantially flat when the activity platform is withdrawn from the exhibition area.

18. A convertible public exhibition facility according to claim 17, wherein said compressible material comprises an elastomeric material.

19. A convertible public exhibition facility according to claim 12, further comprising a pit that is defined between said first and second locations at a location that the activity platform will pass over when being moved, whereby technicians will be able to gain access to the activity platform for purposes of maintenance and repair.

20. A convertible public exhibition facility according to claim 12, wherein said natural grass activity platform includes a plurality of wheels that are positioned to traverse an underlying surface that is built into the stadium, and wherein the natural grass activity platform has a total height measured from a bottom of said wheels to a top of the surface area of natural grass that is no greater than about sixty inches.

21. A convertible public exhibition facility according to claim 20, wherein said natural grass activity platform has a total height that is no greater than about 45 inches.

22. A convertible public exhibition facility according to claim 21, wherein said natural grass activity platform has a total height that is no greater than about 36 inches.

23. A convertible public exhibition facility according to claim 20, wherein said transport mechanism is positioned within said natural grass activity platform.

24. A convertible public exhibition facility according to claim 12, further comprising a plurality of substantially parallel rails secured to a transport surface of said exhibition facility and extending substantially between said first and second locations, and wherein said natural grass activity platform comprises a plurality of wheels that are adapted to respectively traverse said rails.

25. A convertible public exhibition facility according to claim 24, wherein said plurality of wheels comprises at least one lateral stability control wheel having at least one flange for preventing lateral travel of said natural grass activity platform in a direction that is nonparallel to said substantially parallel rails.

26. A convertible public exhibition facility according to claim 25, wherein said plurality of wheels further comprises a plurality of wheels that do not laterally engage an underlying rail, whereby lateral stability of said natural grass activity platform is provided by said lateral stability control wheel and whereby the potential for misalignment of said wheels with respect to said rails as a result of temperature dependent dimensional changes and other factors is reduced.

27. A convertible public exhibition facility according to claim 12, wherein said natural grass activity platform comprises a containment lip about at least a portion of the periphery thereof, and further comprising at least one cushioning number for protecting athletes and other bystanders against injury as a result of contact with said containment lip.

* * * * *